US006694955B1

(12) United States Patent
Griffiths et al.

(10) Patent No.: US 6,694,955 B1
(45) Date of Patent: Feb. 24, 2004

(54) MARINE ENGINE WITH PRIMARY AND SECONDARY FUEL RESERVOIRS

(75) Inventors: John M Griffiths, Fond du Lac, WI (US); George E. Phillips, Oshkosh, WI (US); Wayne M. Jaszewski, Jackson, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/191,169

(22) Filed: Jul. 9, 2002

(51) Int. Cl.[7] ..... F02M 33/04
(52) U.S. Cl. ..... 123/516; 123/509
(58) Field of Search ..... 123/516, 520, 123/509

(56) References Cited

U.S. PATENT DOCUMENTS

| | | | | | |
|---|---|---|---|---|---|
| 5,115,784 | A | | 5/1992 | Mito et al. | 123/516 |
| 5,389,245 | A | | 2/1995 | Jaeger et al. | 210/129 |
| 5,579,740 | A | | 12/1996 | Cotton et al. | 123/516 |
| 5,598,827 | A | | 2/1997 | Kato | 123/518 |
| 5,613,476 | A | * | 3/1997 | Oi et al. | 123/509 |
| 5,636,616 | A | * | 6/1997 | Okane et al. | 123/514 |
| 5,692,479 | A | * | 12/1997 | Ford et al. | 123/514 |
| 5,730,106 | A | | 3/1998 | Gonzalez | 123/516 |
| 5,819,711 | A | | 10/1998 | Motose | 123/516 |
| 5,865,160 | A | | 2/1999 | Kato | 123/516 |
| 6,006,705 | A | | 12/1999 | Kato et al. | 123/73 |
| 6,216,672 | B1 | | 4/2001 | Mishima et al. | 123/516 |
| 6,253,742 | B1 | | 7/2001 | Wickman et al. | 123/516 |
| 6,257,208 | B1 | * | 7/2001 | Harvey | 123/516 |
| 6,331,127 | B1 | * | 12/2001 | Suzuki | 440/88 |
| 6,408,835 | B1 | * | 6/2002 | Katayama et al. | 123/572 |
| 2001/0052292 | A1 | | 12/2001 | Ito | 96/134 |
| 2002/0062819 | A1 | | 5/2002 | Takahashi | 123/519 |

* cited by examiner

*Primary Examiner*—Thomas N. Moulis
(74) *Attorney, Agent, or Firm*—William D. Lanyi

(57) ABSTRACT

A fuel supply system for an internal combustion engine comprises first and second fuel reservoirs connected in fluid communication with each other. The first fuel reservoir is a fuel vapor separator which has a vent conduit connected in fluid communication with a second fuel reservoir. Under normal operation, fuel vapor flows from the fuel vapor separator and into the second fuel reservoir for eventual discharge to the atmosphere. Any liquid fuel caused to flow out of the vent conduit of the fuel vapor separator is contained within the second fuel reservoir and prevented from being discharged into the cavity under the cowl of an outboard motor and eventually into a body of water in which the marine system is operated.

18 Claims, 3 Drawing Sheets

MARINE ENGINE WITH PRIMARY AND SECONDARY FUEL RESERVOIRS

BACKGROUND OF THE INVENTION

1. Field of the Invention

The present invention is generally related to a marine engine with two fuel reservoirs and, more particularly, to a marine engine in which a secondary fuel reservoir has an inlet connected to a vent port of a primary fuel vapor separator to receive vented vapors and liquid fuel overflow from the primary fuel vapor separator.

2. Description of the Prior Art

Many different types of fuel vapor separators are well known for use in conjunction with fuel supply systems for internal combustion engines. Fuel vapor separators are particularly well known for use in conjunction with marine engines.

U.S. Pat. No. 5,389,245, which issued to Jaeger et al on Feb. 14, 1995, discloses a vapor separating unit for a fuel system. The vapor separating unit has particular application to a fuel system for a marine engine. The vapor separating unit includes a closed tank having a fuel inlet through which fuel is fed to the tank by a diaphragm pump. The liquid level in the tank is controlled by a float-operated valve. An electric pump is located within the vapor separating tank and has an inlet disposed in the tank and an outlet connected to a fuel rail assembly of the engine. Excess fuel from the fuel rail assembly is conducted back to the upper end of the vapor separator tank. A vapor venting mechanism is incorporated in the tank to vent vapor from the tank.

U.S. Pat. No. 6,257,208, which issued to Harvey on Jul. 10, 2001, describes a marine vapor separator. A method of controlling fuel temperature while supplying fuel from a fuel tank to an array of fuel injectors of an internal combustion engine comprises the steps of pumping the fuel from a high pressure pump, flowing the fuel through a fuel line from the fuel tank to the high pressure pump, and flowing the fuel through a vapor separator in the fuel line between the tank and the high pressure pump. The method is characterized by recirculating fuel from the vapor separator to the fuel line for leveling fuel temperatures. The method is more specifically characterized by regulating the pressure at which fuel is recirculated from the vapor separator to the fuel line. An assembly for implementing the method includes a unitary housing comprising an upper cap and a lower cap for supporting the filter, the low pressure pump, the first pressure regulator, and the vapor separator. A baffle is disposed at the bottom of the vapor separator for separating fuel flow from the low pressure pump on the first side of the baffle from fuel returned by the fuel line disposed on the second side of the baffle. The first pressure regulator and the recirculation line are also disposed on the first side of the baffle.

U.S. Pat. No. 6,253,742, which issued to Wickman et al on Jul. 3, 2001, discloses a fuel supply method for a marine propulsion engine. The method for controlling the operation of a fuel system of an outboard motor uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

U.S. patent application Ser. No. 09/838,275, which was filed by Ito on Apr. 20, 2001, describes a fuel vapor treatment system. The system is intended for an automotive vehicle on which an internal combustion engine is mounted. The fuel vapor treatment system comprises a canister connected to a fuel tank and containing a fuel vapor absorbing material which generates endothermic energy during desorption of fuel vapor. A membrane separation module is provided to be connected to the canister and including a separation membrane for separating a mixture gas purged from the canister into an air-rich component and a fuel vapor-rich component. Additionally, a condenser is provided to be connected to the membrane separation module to be supplied with the fuel vapor-rich component from the membrane separation module. The condenser is housed in the canister and adapted to cool and liquefy fuel vapor in the fuel vapor-rich component to obtain liquefied fuel by the endothermic energy generated in the canister, the liquefied fuel being recovered.

U.S. Pat. No. 5,730,106, which issued to Gonzalez on Mar. 24, 1998, describes a fuel vapor separator apparatus for diesel engines. The apparatus is intended for de-vaporizing fuel entrained with vapor and has a hollow canister defining a separation chamber. The canister has an input port for receiving the fuel entrained with vapor, an output port in communication with the engine for removal of the de-vapored fuel from the chamber, and a vapor port for removal of the released vapor from the chamber. A screen element is located in the separation chamber of the canister between the input port and the output port for agitating the fuel to release the vapor from the fuel. The apparatus has a valving arrangement for connecting the vapor port to the reservoir. The valving arrangement has at least three ports. The vapor port of the canister is in communication with the first port of the valving arrangement. The reservoir is in communication with the second port of the valving arrangement and ambient air is in communication with the third port. The valving arrangement has a conduit with a control pins for selecting the venting of the separation chamber through the vapor port to either the fuel tank or the ambient air.

U.S. Pat. No. 5,579,740, which issued to Cotton et al on Dec. 3, 1996, describes a fuel handling system for an internal combustion engine having a vapor separator for receiving fuel from a remote tank and a pump for delivering the fuel under high pressure to a fuel injector of the engine while providing vapor separation. The separator has an inlet for receiving fuel from the tank, an outlet for enabling fuel to be removed and delivered to the engine, at least one return for enabling fuel not used by the engine to be returned to the separator, and a vent for removing fuel vapor from a gas dome above a pool of liquid fuel within the separator. The inlet has a valve controlled by a float in the reservoir for admitting fuel to maintain the level of liquid fuel in the separator. To retard foaming and excessive vaporization of liquid fuel in the separator, the separator has a perforate baffle between any return and the liquid fuel pool.

U.S. Pat. No. 5,115,784, which issued to Mito et al on May 26, 1992, describes a fuel injection system of an outboard motor which is provided with a vapor separator as a fuel tank disposed in the outboard motor and the system includes a fuel return pipe connected to the vapor separator, a fuel supply pipe connected to the vapor separator for supplying fuel to the fuel injector and a vent means connected to the vapor separator. The vent means is connected to a port formed to the throttle body through a connection hose on a upstream side of the throttle valve. The port formed in the throttle valve is opened at a portion at which an air flows in the throttle body with highest flowing speed and upstream and downstream sides of the throttle valve are connected through a bypass passage which is provided with a port on the upstream side of the throttle valve opened near the port formed to the throttle body.

U.S. Pat. No. 5,598,827, which issued to Kato on Feb. 4, 1997, describes a high pressure fuel feeding device for a fuel injected engine. An outboard motor has a fuel/air injection system wherein all of the major components of the fuel portion of the fuel/air injection system are contained within a sealed chamber having a fuel drain and the conduits that supply fuel to the fuel injectors are also contained within fuel collecting conduits so that any fuel leaking will not escape back to the atmosphere. In addition, the air pressure supplied to the fuel/air injectors is regulated and the air relieved for pressure regulation is returned to an air inlet device having a baffle for condensing any fuel in the regulated air and returning the condensed fuel to a vapor separator.

U.S. Pat. No. 5,819,711, which issued to Motose on Oct. 13, 1998, describes a vapor separator for a fuel injected engine. A fuel injection system for an internal combustion engine and particularly for an outboard motor is described. The system includes a fuel vapor separator that is disposed on one side of the throttle bodies at the front of the engine. The fuel vapor separator is comprised of a housing assembly having a cover plate in which an integral fuel inlet fitting, an integral outlet fitting, an integral vent fitting and an integral fuel return fitting are formed. The fuel injectors for the engine are disposed on the opposite side of the throttle bodies from the fuel vapor separator and are supplied with fuel through a vertically extending fuel rail. The pressure regulator is positioned at the top of the fuel rail and the fuel rail is directly affixed to the throttle bodies.

U.S. Pat. No. 5,865,160, which issued to Kato on Feb. 2, 1999, describes a fuel supply system for an outboard motor. The fuel supply system minimizes and curbs fuel spillage when the outboard motor is placed in a non-upright position. The fuel supply system includes an internal fuel tank which communicates with at least one intake passage of an engine of the outboard motor via a fuel vapor discharge line. The discharge line extends between a vapor discharge port on the fuel tank and a vapor suction port on the engine. The ports and the discharge line are arranged within the outboard motor to inhibit significant spillage or drainage of liquid fuel from the fuel tank through the vapor discharge line regardless of the orientation of the outboard motor, such as, for example, when the outboard motor is inverted or is laid over on its side.

U.S. Pat. No. 6,006,705, which issued to Kato et al on Dec. 28, 1999, describes a fuel injection system. The system includes a main fuel source and a pump for delivering fuel from the main fuel source through a fuel filter to a vapor separator. Fuel is supplied from the chamber by a high pressure pump through a fuel rail to one or more fuel injectors. Undelivered fuel is returned to the vapor separator through a return line. Oil is mixed into the fuel between the fuel filter and the high pressure pump, so that the high pressure pump draws a mixture of fuel and oil and delivers it to the charge formers and fuel return.

U.S. Pat. No. 6,216,672, which issued to Mishima et al on Apr. 17, 2001, describes a fuel supply system for an outboard motor. The fuel injection system includes a fuel supply system which comprises a fuel tank in which a fuel is stored, a low pressure fuel filter and a low pressure fuel pump connected to the fuel tank through a fuel supply hose, a vapor separator connected to the low pressure fuel pump through a low pressure fuel hose, a high pressure fuel pump disposed inside the vapor separator, a pressure regulator disposed inside the vapor separator, a fuel hose having one end connected to the high pressure fuel pump, a branch pipe incorporated on the way of the fuel hose and having one end connected to the pressure regulator, and a delivery pipe connected to another one end of the branch pipe. A fuel injector is connected to the delivery pipe and adapted to inject the fuel with pressure regulated by the pressure regulator.

U.S. patent application Ser. No. 09/994,435, which was filed on Nov. 26, 2001, by Takahashi, describes a fuel supply system for a four cycle outboard motor. An arrangement for a four cycle, direct injected engine for an outboard motor is disclosed. The engine includes a fuel injection system that includes a fuel pump, a plurality of fuel injectors, and a vapor separator. The vapor separator is connected in fluid communication with the fuel pump and at least one fuel return line. The vapor separator includes a vent for removing vapors from the fuel. The vapor separator also includes a canister positioned within the vapor separator below the vent. The canister includes hydrocarbon absorption media.

The patents described above are hereby expressly incorporated by reference in the description of the present invention.

Existing fuel systems which use a single fuel vapor separator are subject to certain problems that can be significantly disadvantageous. For example, if the pumping system that pumps liquid fuel into the fuel vapor separator experiences a failure which causes the fuel vapor separator to be overfilled, excess liquid fuel can be caused to flow out of the fuel vapor separator, through the vent opening under the cowl, and into the body of water in which the marine propulsion system is operating. In this type of overfilling failure, the entire fuel tank of a marine vessel can be emptied, through the fuel vapor separator vent opening, into the body of water. This fuel spillage would typically first create a dangerous situation with excess liquid fuel being pumped into the region under the cowl of an outboard motor and then eventually into the body of water. Even without the fuel system failure, described above, fuel vapors emitted from the vent of the fuel vapor separator can condense in the vicinity of the internal combustion engine.

It would be significantly beneficial if the deleterious conditions described above could be avoided by capturing the fluid which is vented from the fuel vapor separator.

SUMMARY OF THE INVENTION

A marine propulsion system made in accordance with the present invention comprises a first fuel reservoir, such as a fuel vapor separator. It also comprises a first fuel pump, or high pressure pump, connected in fluid communication between the first fuel reservoir and a fuel supply device of an internal combustion engine. The fuel supply device can be a fuel rail through which liquid fuel is pumped to fuel injectors. The present invention further comprises a vent conduit which is connected in fluid communication with the first fuel reservoir. The vent conduit is used to conduct fuel vapor out of the first fuel reservoir. The present invention further comprises a second fuel reservoir having an inlet and an outlet. The inlet is connected in fluid communication with the vent conduit for receiving the fuel vapor which flows from the first fuel reservoir. As described above, the first fuel reservoir can be a fuel vapor separator and the fuel supply device can be a fuel rail.

The present invention, in a particularly preferred embodiment, further comprises a check valve that is connected in fluid communication with the outlet of the second fuel reservoir. The check valve is responsive to a liquid fuel level within the second fuel reservoir in order to block the outlet of the second fuel reservoir when a level of the liquid fuel exceeds a preselected magnitude within the second fuel reservoir. A preferred embodiment of the present invention further comprises a second fuel pump, or low pressure pump, which is connected in fluid communication to the first fuel reservoir for drawing fuel from a fuel tank of a marine vessel and causing the fuel to flow into the first fuel reservoir.

Certain embodiments of the present invention can further comprise a pressure sensitive check valve connected in fluid communication with the second fuel pump to bypass the fuel from an outlet of the second fuel pump to an inlet of the second fuel pump when the fuel pressure at the outlet of the second fuel pump exceeds a predetermined threshold magnitude. A preferred embodiment of the present invention further comprises a fuel filter connected in fluid communication between the fuel tank and the second fuel pump. The marine propulsion system can be an outboard motor and the first and second fuel reservoirs can be disposed under a cowl of the outboard motor. In a particularly preferred embodiment of the present invention, the internal volume of the second fuel reservoir is equal to or larger than the internal effective volume of the first fuel reservoir. In addition, in a preferred embodiment of the present invention, the second fuel reservoir is disposed at a higher elevation than the first fuel reservoir.

A preferred embodiment of the present invention can further comprise a fuel cooler connected in fluid communication with a fuel return conduit which is connected in fluid communication between the fuel supply device and the first fuel reservoir. The present invention, in a particularly preferred embodiment, can further comprise a pressure regulator connected in fluid communication with the fuel return conduit to control fuel pressure within the fuel supply device within a preselected pressure magnitude range.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
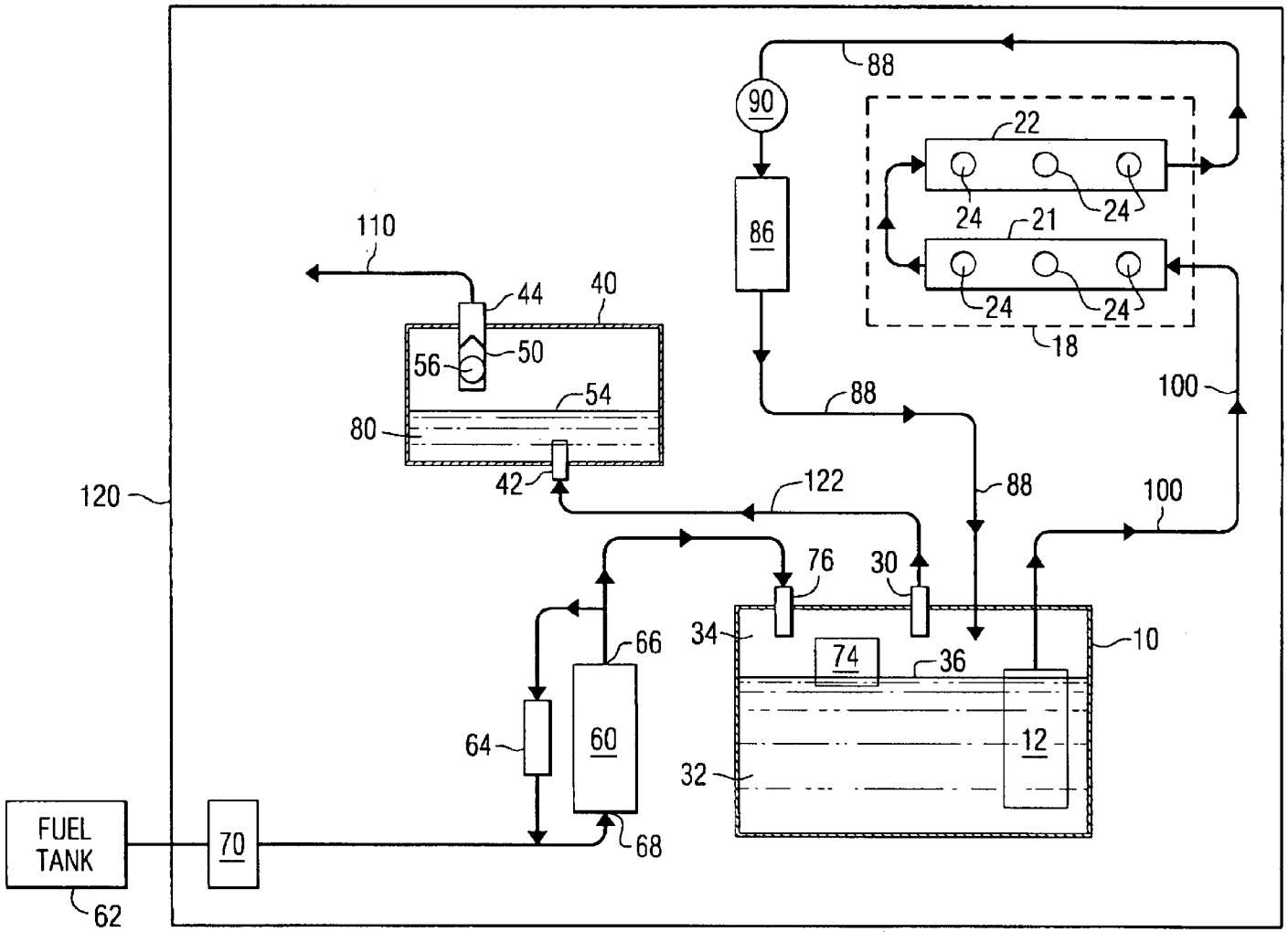
FIG. 1 is a schematic representation of a marine fuel system incorporating the present invention.

Throughout the description of the preferred embodiment of the present invention, like components will be identified by like reference numerals.

FIG. 1 is a schematic representation of a marine propulsion system incorporating the present invention. A first fuel reservoir 10, or fuel vapor separator, is provided with a first fuel pump 12 that is connected in fluid communication between the first fuel reservoir 10 and a fuel supply device of an internal combustion engine 18. In FIG. 1, the first fuel pump is shown disposed within the internal cavity of the first fuel reservoir 10, but it should be clearly understood the position of the first fuel pump 12 within the fuel vapor separator is not a requirement in all embodiments of the present invention. In FIG. 1, the fuel supply device is illustrated as comprising two fuel rails, 21 and 22, wherein each is connected to a plurality of fuel injector devices 24. As represented by the arrows in FIG. 1, fuel is pumped from the fuel vapor separator 10 by the first fuel pump 12, or high pressure pump, and the fuel is caused to flow serially through the two fuel rails, 21 and 22, of the fuel supply device to the fuel injector devices 24.

A vent conduit 30 is connected in fluid communication with the first fuel reservoir 10 to allow fuel vapor to flow out of the first fuel reservoir 10. As illustrated in FIG. 1, the fuel within the fuel vapor separator 10 comprises liquid fuel 32 and fuel vapor 34. Dashed line 36 represents the liquid surface or interface between the liquid fuel 32 and the fuel vapor 34 contained within the ullage of the fuel vapor separator 10.

A second fuel reservoir 40 is provided with an inlet 42 and an outlet 44. The inlet 42 is connected in fluid communication with the vent conduit 30 of the first fuel reservoir 10 for receiving fuel vapor 34 flowing from the first fuel reservoir 10. Although the vent conduit 30 is intended to allow the flow of fuel vapor 34 from the first fuel reservoir 10, it should be understood that under certain circumstances, which will be described below, liquid fuel can also flow upwardly through the vent conduit 30 and toward the inlet 42 of the second fuel reservoir 40.

With continued reference to FIG. 1, a check valve 50 is connected in fluid communication with the outlet 44 of the second fuel reservoir 40. The check valve 50 is responsive to a liquid fuel level 54 within the second fuel reservoir 40 and is intended to block the outlet 44 of the second fuel reservoir 40 when the liquid fuel level 54 exceeds a preselected magnitude. The check valve 50 is illustrated in FIG. 1 as having a floating ball member 56 disposed within a containment so that the floating ball member 56 will block flow through the outlet 44 when the liquid level 54 raises the ball 56 into a blocking arrangement within the check valve 50. These types of devices are well known to those skilled in the art.

A second fuel pump 60, or low pressure pump, is connected in fluid communication with the first fuel reservoir 10 for drawing fuel from a fuel tank 62 and causing the fuel to flow into the first reservoir 10. A pressure sensitive check valve 64 is connected in fluid communication with the second fuel pump 60 to bypass fuel from an outlet 66 of the second fuel pump 60 to an inlet 68 of the second fuel pump 60 when the fuel pressure at the outlet 66 of the second fuel pump exceeds a predetermined threshold magnitude. A fuel filter 70 is connected in fluid communication between the fuel tank 62 and the second fuel pump 60.

The internal volume of the second fuel reservoir 40, in a particularly preferred embodiment of the present invention, is equal to or larger than the internal effective volume of the first fuel reservoir 10. It should be noted that, in FIG. 1, the first fuel reservoir 10 contains the first fuel pump 12 and a float mechanism 74 that is responsive to the fuel level 36 within the first fuel reservoir 10 in order to block an inlet valve 76 and prevent the overfilling of the fuel vapor separator 10. In a preferred embodiment of the present invention, the second fuel reservoir 40 is disposed at a higher elevation than the first fuel reservoir 10. In other words, the vapor flowing through the vent conduit 30 flows upwardly, against the force of gravity, toward the inlet 42 of the second fuel reservoir 40. Similarly, if any liquid fuel 80 is contained within the second fuel reservoir 40, it is able to flow downwardly, under the effect of gravity, through the inlet 42 of the second fuel reservoir 40 and through the vent conduit 30 back into the fuel vapor separator 10 if the relative pressures within the first and second fuel reservoirs, 10 and 40 allow this return flow.

With continued reference to FIG. 1, a fuel cooler 86 is connected in fluid communication with a fuel return conduit 88 which, in turn, is connected in fluid communication between the fuel rails, 21 and 22, of the fuel supply device and the first fuel reservoir 10. A pressure regulator 90 is connected in fluid communication with the fuel return conduit 88 to control the fuel pressure within the fuel rails, 21 and 22, of the fuel supply device within a preselected pressure magnitude range.

With continued reference to FIG. 1, the second pump 60 draws fuel from the fuel tank 62 through the fuel filter 70 and into the fuel vapor separator 10. The float mechanism 74 blocks the fuel inlet 76 when the fuel level 36 exceeds a preselected magnitude. If the pressure at the outlet 66 of the second fuel pump 60 exceeds a predetermined magnitude determined by a pressure regulator 64, fuel is caused to flow from the outlet 66 of the second fuel pump 60 back to its inlet 68 as represented in FIG. 1. Under normal conditions, the first fuel pump 12 pumps liquid fuel 32 from the first fuel reservoir 10, through conduit 100. This fuel flows through the first and second fuel rails, 21 and 22, and then through a fuel return conduit 88 back to the fuel vapor separator 10. It should be understood that alternative embodiments of the present invention could use a "dead head" arrangement that does not return the fuel to the fuel vapor separator 10 in precisely the same method as illustrated in FIG. 1. The returning fuel, flowing through the fuel return conduit 88, passes through a pressure regulator 90 and a fuel cooler 86. The pressure regulator 90 maintains a desired pressure range within the first and second fuel rails, 21 and 22, and the fuel cooler 86 reduces the temperature of the returning fuel. If the pressure of the fuel vapor 34 within the ullage of the first fuel reservoir 10 exceeds the pressure within the second fuel reservoir 40, fuel vapor flows upwardly through the vent conduit 30 and through the inlet 42 of the second fuel reservoir 40. Under normal circumstances, the fuel vapor is then allowed to flow upwardly through the check valve 50 to exit through conduit 110. It should be realized that some of the fuel vapor flowing along this path may condense to a liquid state 80 within the second fuel reservoir 40. The remaining fuel vapor is discharged through conduit 110.

If a failure occurs in relation to the second fuel pump 60, the float valve 74, or related components, the second fuel pump 60 may overfill the internal cavity of the first fuel reservoir 10. If this malfunction occurs, liquid fuel 32 can be caused to flow upwardly through the vent conduit 30. In known systems, this liquid fuel would then exit from the first fuel reservoir 10 and be discharged into the region under the cowl 120 in FIG. 1. This is a significantly disadvantageous circumstance. The present invention, however, directs this liquid fuel through conduit 122 toward the inlet 42 of the second fuel reservoir 40. The liquid fuel is therefore contained within the second fuel reservoir 40 and is not allowed to be discharged into the region under the cowl 120 or, eventually, into the body of water in which the marine propulsion system is operated. In the event that the liquid fuel level 54 within the second fuel reservoir 40 rises to a level that is sufficient to raise the floating ball 56 of check valve 50, the check valve 50 closes the outlet 44 to prevent liquid fuel from flowing through the discharge conduit 110. Operation of the check valve 50 will create a sufficiently increased pressure within the cavity of the fuel vapor separators, 10 and 40, to cause fuel flowing from the outlet 66 of the second fuel pump 60 to flow through the pressure sensitive check valve 64 back to the inlet 68 of the second fuel pump 60. This will prevent further fuel from being pumped into the first fuel reservoir 10 and eventually toward the second fuel reservoir 40.

Figure 2:
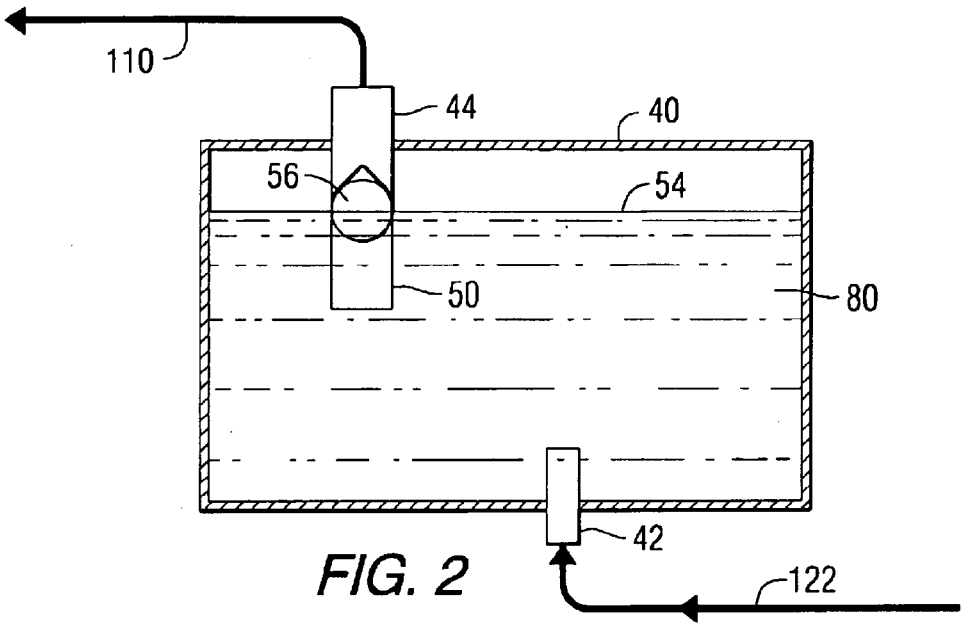
FIG. 2 shows the second fuel reservoir of the present invention.

FIG. 2 is an illustration of the second fuel reservoir 40 which shows a fuel level 54 that is sufficient to raise the floating ball 56 to a position that closes the check valve 50 to block further flow of fluid through the outlet 44 of the second fuel reservoir 40. The operation of the check valve 50 prevents the liquid fuel level 54 from exceeding a magnitude that would induce a flow of liquid fuel through the outlet 44. As a result of the operation of the check valve 50, pressure increases within the second fuel reservoir 40 and within the conduit 122 that is connected to the vent conduit 30 described above in conjunction with FIG. 1. As discussed above, this increased pressure is reflected in the pressure within the first fuel reservoir 10 and causes fuel to be bypassed around the second fuel pump 60. This, in turn, prevents a further flow of liquid fuel through the vent conduit 30 and conduit 122.

Figure 3:
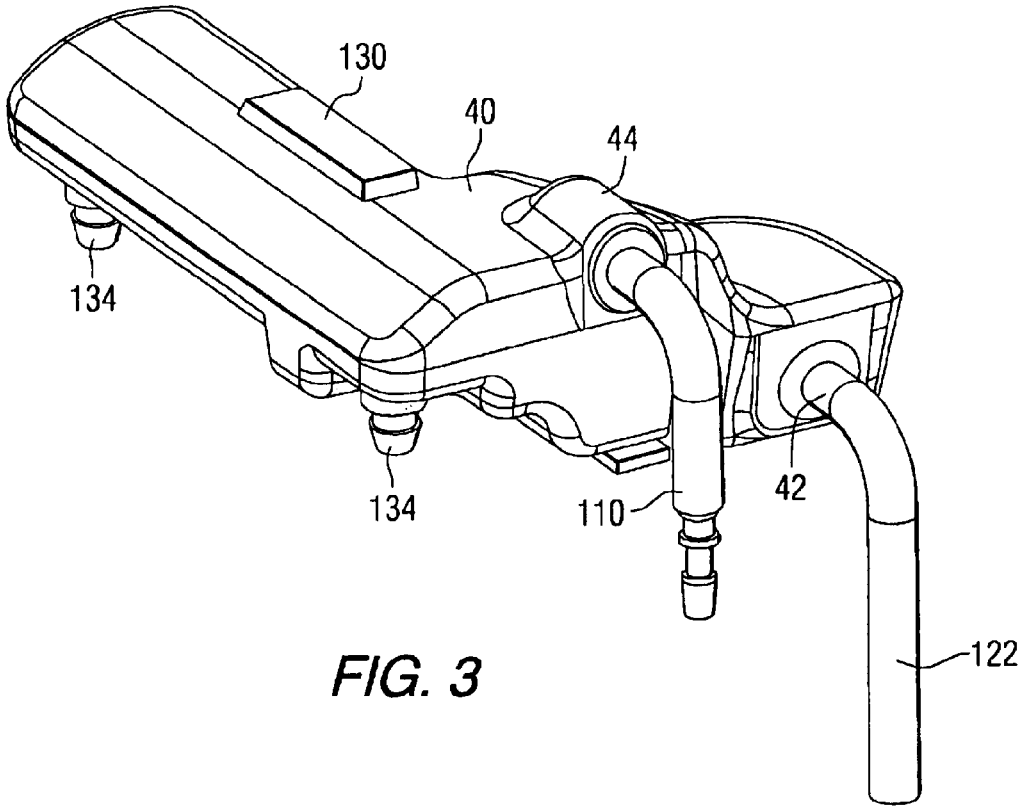
FIG. 3 is an isometric view of the second reservoir of the present invention.

FIG. 3 is an isometric representation of the second fuel reservoir 40. The inlet conduit 122 is connected to the inlet 42 of the second fuel reservoir 40 to allow fuel vapor to flow upwardly from the vent conduit 30 of the fuel vapor separator 10, as described above in conjunction with FIGS. 1 and 2. It should also be recognized that liquid fuel can flow through conduit 122 under circumstances when the second fuel pump 60 or its associated components experience a malfunction. Fuel vapor flows through the internal cavity of the second fuel reservoir 40 and through the outlet 44 to be discharged through conduit 110. In a preferred embodiment, the second fuel reservoir 40 is made of blow-molded plastic or a similar construction. A foam rubber mounting pad 130 is attached to the top portion of the second fuel reservoir 40 and rubber mounting pads 134 are attached to a portion of its lower surface to assist in mounting the second fuel reservoir 40 to an internal combustion engine.

Figure 4:
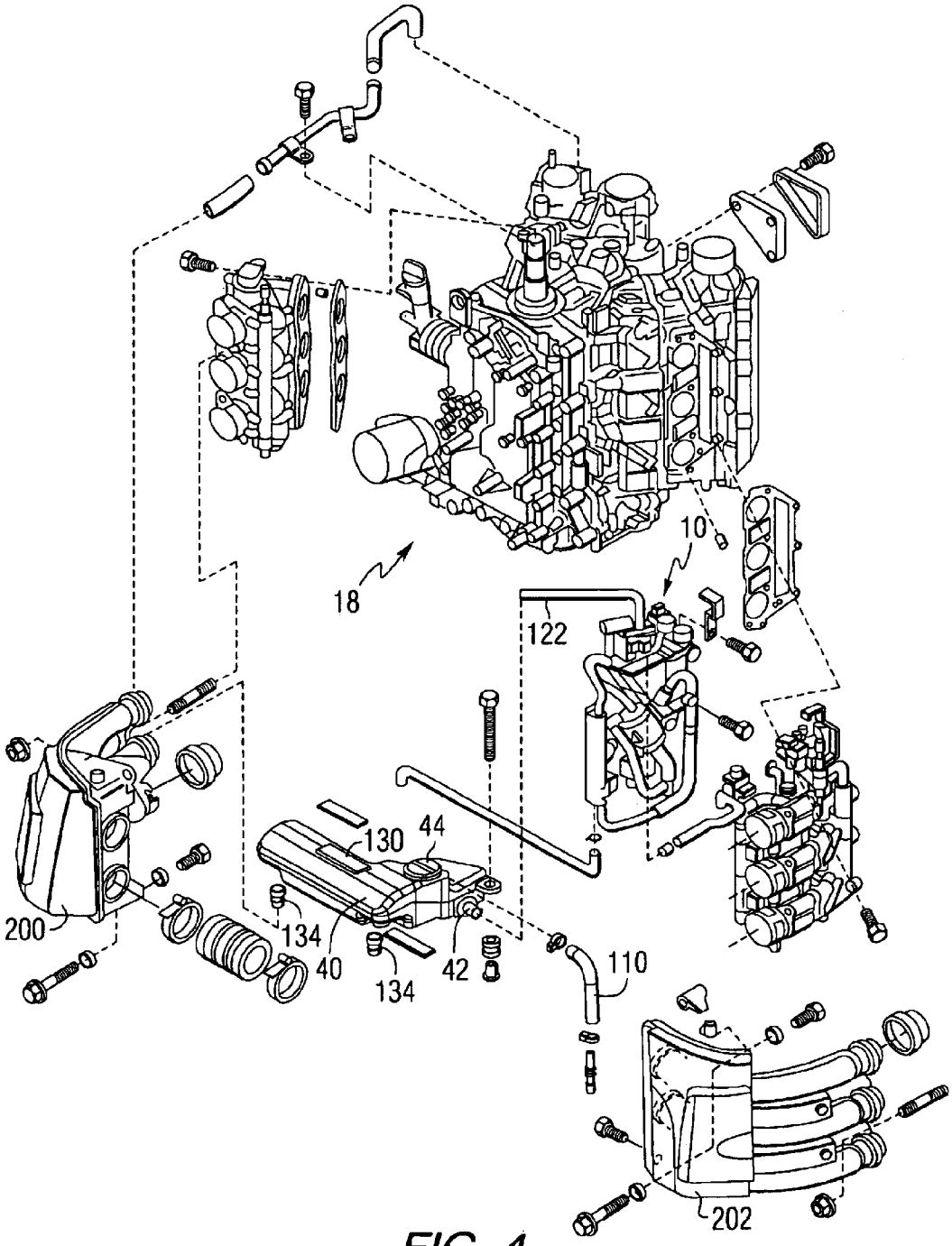
FIG. 4 is an exploded view of an internal combustion engine incorporating the first and second fuel reservoirs of the present invention.

FIG. 4 is an exploded isometric view of an internal combustion engine configured in an arrangement that includes the present invention. The engine 18 is provided with an intake silencer 200 for its starboard side and an intake silencer 202 for its port side. The second fuel reservoir 40 is shown with its mounting pads, 130 and 134, its inlet 42, and its outlet 44. The inlet is positioned for attachment to the vent line 122 which is connected to the fuel vapor separator 10. The exhaust line 110 is positioned to be connected to the outlet 44. The other components illustrated in FIG. 4 are not directly related to the operation or structure of the invention, but are shown for purposes of providing perspective relating to the overall structure of the internal combustion engine 18 and its associated components. Those unidentified components include throttle bodies, bushings, collars, bolts, clamps, gaskets, screws, hoses, and clips whose functions are well understood by those skilled in the art.

The present invention provides a significant advantage by incorporating a secondary reservoir, such as the second fuel reservoir 40, to receive overflow spillage of liquid fuel from the first fuel reservoir 10, or fuel vapor separator. In addition, condensed fuel vapor is collected within the second fuel reservoir 40. When the internal combustion engine 18 is turned off, and the relative pressures of the internal cavities of the first and second fuel reservoirs, 10 and 40, allow, liquid fuel 80 can flow downwardly through the inlet 42 of the second fuel reservoir 40, through the vent conduit 30, and back into the first fuel reservoir 10. In addition to managing the effective flow of fuel vapor from the vent conduit 30 of the fuel vapor separator 10, the present invention provides a significant benefit in preventing the disadvantageous results that could otherwise occur because of an overfilling malfunction that pumps more liquid fuel into the first fuel reservoir 10 than it can hold.

Although the present invention has been described with particular specificity and illustrated to show a preferred embodiment, it should be understood that alternative embodiments are also within its scope.

We claim:

1. A marine propulsion system, comprising:

a first fuel reservoir;

a first fuel pump connected between said first fuel reservoir and a fuel supply device of an internal combustion engine;

a vent conduit connected to said first fuel reservoir through which fuel vapor can flow out of said first fuel reservoir;

a second fuel reservoir having an inlet and an outlet, said inlet being connected in fluid communication with said vent conduit for receiving said fuel vapor flowing from said first fuel reservoir; and a second fuel pump connected to said first fuel reservoir for drawing fuel from a fuel tank and causing said fuel to flow into said first fuel reservoir;

a pressure sensitive check valve connected in fluid communication with said second fuel pump to bypass said fuel from an outlet of said second fuel pump to an inlet of said second fuel pump when the fuel pressure at said outlet of said second fuel pump exceeds a predetermined threshold magnitude.

2. The marine propulsion system of claim 1, wherein:

said first fuel reservoir is a fuel vapor separator.

3. The marine propulsion system of claim 1, wherein:

said fuel supply device is a fuel rail.

4. The marine propulsion system of claim 1, further comprising:

a check valve connected in fluid communication with said outlet of said second fuel reservoir, said check valve being responsive to a liquid fuel level within said second fuel reservoir to block said outlet of said second fuel reservoir when a level of said liquid fuel exceeds a preselected magnitude.

5. The marine propulsion system of claim 1, further comprising:

a fuel filter connected in fluid communication between said fuel tank and said second fuel pump.

6. The marine propulsion system of claim 1, wherein:

said marine propulsion system is an outboard motor.

7. The marine propulsion system of claim 1, wherein:

said first and second fuel reservoirs are disposed under a cowl of said outboard motor.

8. The marine propulsion system of claim 1, wherein:

the internal volume of said second fuel reservoir is equal to or larger than the internal effective volume of said first fuel reservoir.

9. The marine propulsion system of claim 1, wherein:

said second fuel reservoir is disposed at a higher elevation than said first fuel reservoir.

10. The marine propulsion system of claim 1, further comprising:

a fuel cooler connected in fluid communication with a fuel return conduit which is connected in fluid communication between said fuel supply device and said first fuel reservoir.

11. The marine propulsion system of claim 8, further comprising:

a pressure regulator connected in fluid communication with a fuel return conduit to control fuel pressure within said fuel supply device within a preselected pressure magnitude range.

12. A marine propulsion system, comprising:

a fuel vapor separator;

a first fuel pump connected between said fuel vapor separator and a fuel supply device of an internal combustion engine;

a vent conduit connected to said fuel vapor separator through which fuel vapor can flow out of said fuel vapor separator;

a fuel reservoir having an inlet and an outlet, said inlet being connected in fluid communication with said vent conduit for receiving said fuel vapor flowing from said fuel vapor separator; and a fuel cooler connected in fluid communication with a fuel return conduit which is connected in fluid communication between said fuel supply device and said fuel reservoir.

13. The marine propulsion system of claim 12, further comprising:

a check valve connected in fluid communication with said outlet of said fuel reservoir, said check valve being responsive to a liquid fuel level within said fuel reservoir to block said outlet of said fuel reservoir when a level of said liquid fuel exceeds a preselected magnitude.

14. The marine propulsion system of claim 13, further comprising:

a second fuel pump connected to said fuel vapor separator for drawing fuel from a fuel tank and causing said fuel to flow into said fuel vapor separator.

15. The marine propulsion system of claim 14, further comprising:

a pressure sensitive check valve connected in fluid communication with said second fuel pump to bypass said fuel from an outlet of said second fuel pump to an inlet of said second fuel pump when the fuel pressure at said outlet of said second fuel pump exceeds a predetermined threshold magnitude.

16. The marine propulsion system of claim 15, wherein:

said marine propulsion system is an outboard motor; and said fuel vapor separator and said fuel reservoir are disposed under a cowl of said outboard motor.

17. The marine propulsion system of claim 16, wherein:

said fuel reservoir is disposed at a higher elevation than said fuel vapor separator.

18. A marine propulsion system, comprising:

a fuel vapor separator;

a first fuel pump connected between said fuel vapor separator and a fuel supply device of an internal combustion engine;

a vent conduit connected to said fuel vapor separator through which fuel vapor can flow out of said fuel vapor separator;

a fuel reservoir having an inlet and an outlet, said inlet being connected in fluid communication with said vent conduit for receiving said fuel vapor flowing from said fuel vapor separator;

a check valve connected in fluid communication with said outlet of said fuel reservoir, said check valve being responsive to a liquid fuel level within said fuel reservoir to block said outlet of said fuel reservoir when a level of said liquid fuel exceeds a preselected magnitude;

a second fuel pump connected to said fuel vapor separator for drawing fuel from a fuel tank and causing said fuel to flow into said fuel vapor separator; and a pressure sensitive check valve connected in fluid communication with said second fuel pump to bypass said fuel from an outlet of said second fuel pump to an inlet of said second fuel pump when the fuel pressure at said outlet of said second fuel pump exceeds a predetermined threshold magnitude.

* * * * *